US011280228B2

(12) United States Patent
McCloy

(10) Patent No.: US 11,280,228 B2
(45) Date of Patent: Mar. 22, 2022

(54) VARIABLE CAMSHAFT TIMING ASSEMBLY

(71) Applicant: BorgWarner, Inc., Auburn Hills, MI (US)

(72) Inventor: Chad McCloy, Cortland, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/922,180

(22) Filed: Jul. 7, 2020

(65) Prior Publication Data

US 2022/0010700 A1 Jan. 13, 2022

(51) Int. Cl.
*F01L 1/352* (2006.01)
*F01L 1/047* (2006.01)

(52) U.S. Cl.
CPC ..... *F01L 1/352* (2013.01); *F01L 1/047* (2013.01)

(58) Field of Classification Search
CPC . F01L 2001/0473; F01L 1/3442; F01L 1/047; F01L 1/344; F01L 1/352; F01L 2001/34493; F01L 1/34413
USPC ..... 123/90.17, 90.15, 90.16, 90.31
See application file for complete search history.

(56) References Cited

U.S. PATENT DOCUMENTS 3,516,394 A * 6/1970 Roy ..... F01L 1/34413 123/90.17
5,417,186 A 5/1995 Elrod et al.
6,044,816 A 4/2000 Buck et al.
6,253,719 B1 7/2001 Methley
7,536,986 B2 5/2009 Schneider
7,597,075 B2 * 10/2009 Schafer ..... F01L 1/352 123/90.15
7,866,293 B2 1/2011 Clever et al.
7,938,090 B2 5/2011 Lancefield et al.
(Continued)

FOREIGN PATENT DOCUMENTS

DE 4007181 A1 * 9/1991 ..... F01L 1/34
DE 102008017456 A1 * 10/2009 ..... F01L 1/344
(Continued)

*Primary Examiner* — Patrick Hamo
*Assistant Examiner* — Wesley G Harris
(74) *Attorney, Agent, or Firm* — Reising Ethington P.C.

(57) ABSTRACT

A variable camshaft timing (VCT) assembly includes an independent VCT device that can couple with a first camshaft and change an angular position of the first camshaft relative to the angular position of a crankshaft. The independent VCT device has a stator and an output fixedly coupled with the first camshaft. The VCT assembly also includes a dependent VCT device that angularly adjusts a second camshaft in response to angular adjustment of the first camshaft. The dependent VCT device has a camshaft link coupled with the output of the independent VCT device; the camshaft link has a slot positioned radially outwardly from an axis of camshaft rotation. The independent VCT device also includes a planetary gear link having a geared surface configured to engage a geared surface coupled to the second camshaft, a planetary gear pin received by the slot of the camshaft link, and a planetary gear pivot; angular movement of the output relative to the stator moves the planetary gear pin relative to the slot and the planetary gear link about the pivot thereby transmitting angular motion of the first camshaft to the second camshaft through the planetary gear link.

20 Claims, 10 Drawing Sheets

(56) References Cited

U.S. PATENT DOCUMENTS

| | | | |
|---|---|---|---|
| 8,113,159 | B2 | 2/2012 | Myers et al. |
| 8,122,863 | B2 | 2/2012 | Myers |
| 8,146,551 | B2 | 4/2012 | Pluta |
| 8,191,521 | B2 | 6/2012 | Kandolf et al. |
| 8,256,393 | B2 | 9/2012 | Simpson et al. |
| 8,261,705 | B2 | 9/2012 | Lancefield et al. |
| 8,336,512 | B2 | 12/2012 | Myers et al. |
| 8,375,906 | B2 | 2/2013 | Myers et al. |
| 8,522,737 | B2 | 9/2013 | Yokoyama et al. |
| 8,596,236 | B2 | 12/2013 | Chung et al. |
| 8,677,960 | B2 | 3/2014 | Knecht et al. |
| 8,695,545 | B2 | 4/2014 | Tateno |
| 8,978,605 | B2 | 3/2015 | Friedrichs |
| 9,297,281 | B2 | 3/2016 | Sisson et al. |
| 9,297,283 | B2 | 3/2016 | Schafer et al. |
| 9,366,159 | B2 | 6/2016 | Wigsten et al. |
| 9,506,379 | B2 | 11/2016 | Dupuis |
| 9,512,747 | B2 | 12/2016 | Kim |
| 9,638,306 | B2 | 5/2017 | Schafer et al. |
| 9,797,277 | B2 | 10/2017 | Chung et al. |
| 9,840,942 | B2 | 12/2017 | Zwahr et al. |
| 2001/0035140 | A1* | 11/2001 | Fernandez ..... F01L 13/0005 123/90.15 |
| 2005/0051121 | A1 | 3/2005 | Smith |
| 2005/0056249 | A1 | 3/2005 | Heinze et al. |
| 2008/0196681 | A1 | 8/2008 | Lancefield et al. |
| 2013/0092114 | A1 | 4/2013 | Pietsch et al. |
| 2014/0190434 | A1 | 7/2014 | Bayrakdar |
| 2015/0068474 | A1 | 3/2015 | Kim et al. |
| 2017/0254232 | A1 | 9/2017 | Stays |

FOREIGN PATENT DOCUMENTS

| | | | | |
|---|---|---|---|---|
| DE | 102008055837 | A1 * | 5/2010 | ..... F01L 1/3442 |
| DE | 102012023325 | A1 * | 6/2014 | ..... F01L 1/352 |
| DE | 102013020953 | A1 * | 6/2015 | ..... F16H 19/001 |
| DE | 102014008155 | A1 * | 12/2015 | ..... F01L 1/344 |
| EP | 3141711 | A1 | 3/2017 | |
| GB | 2401163 | A | 11/2004 | |
| WO | WO-02101207 | A1 * | 12/2002 | ..... F01L 13/0057 |

* cited by examiner

VARIABLE CAMSHAFT TIMING ASSEMBLY

TECHNICAL FIELD

The present application relates to internal combustion engines (ICEs) and, more particularly, to variable camshaft timing (VCT) used with the ICEs.

BACKGROUND

Internal combustion engines (ICEs) use one or more camshafts to open and close intake and exhaust valves in response to cam lobes selectively actuating valve stems as the camshaft(s) rotate overcoming the force of valve springs that keep the valves seated and displacing the valves. The shape and angular position of the cam lobes can affect the operation of the ICE. In the past, the angular position of the camshaft relative to the angular position of the crankshaft was fixed. But it is possible to vary the angular position of the camshaft relative to the crankshaft using variable camshaft timing (VCT). VCT can be implemented using VCT devices (sometimes referred to as camshaft phasers) that change the angular position of the camshaft relative to the crankshaft. These camshaft phasers can be hydraulically- or electrically-actuated and are typically directly attached to one end of the camshaft.

The angular position of separate camshafts can each be varied relative to the crankshaft. One VCT device can be coupled with one of the camshafts to change the angular position of that camshaft relative to the crankshaft and another VCT device can be coupled with the other of the camshafts to change the angular position of the other camshaft relative to the crankshaft. However, the use of two VCT devices that each independently controls the angular position of a camshaft relative to the crankshaft can be complex. It would be helpful to decrease the cost and complexity of the VCT assembly.

SUMMARY

In one implementation, a variable camshaft timing (VCT) assembly includes an independent VCT device that can couple with a first camshaft and change an angular position of the first camshaft relative to the angular position of a crankshaft. The independent VCT device has a stator and an output fixedly coupled with the first camshaft. The VCT assembly also includes a dependent VCT device that angularly adjusts a second camshaft in response to angular adjustment of the first camshaft. The dependent VCT device has a camshaft link coupled with the output of the independent VCT device; the camshaft link has a slot or a planetary gear pin positioned radially outwardly along an axis of camshaft rotation. The independent VCT device also includes a planetary gear link having a geared surface configured to engage a geared surface coupled to the second camshaft, the other of the slot or the planetary gear pin received by the slot of the camshaft link, and a planetary gear pivot; angular movement of the output relative to the stator moves the planetary gear pin relative to the slot and the planetary gear link about the pivot thereby transmitting angular motion of the first camshaft to the second camshaft through the planetary gear link.

In another implementation, a VCT assembly for controlling the angular position of camshafts includes an independent VCT device that is configured to couple with a first camshaft and change an angular position of the first camshaft relative to the angular position of a crankshaft. The independent VCT device has a rotor, having one or more vanes extending radially outwardly from a hub, fixedly coupled with the first camshaft and a stator that receives the rotor within a cavity permitting angular displacement of the rotor relative to the stator. The VCT assembly also includes a dependent VCT device that angularly adjusts a second camshaft in response to angular adjustment of the first camshaft; the dependent VCT device includes a camshaft link, coupled with the rotor of the independent VCT device, having a slot positioned radially, outwardly from an axis of camshaft rotation. The dependent VCT device also includes a planetary gear link having a geared surface configured to engage a geared surface coupled to the second camshaft, a planetary gear pin received by the slot of the camshaft link, and a planetary gear pivot that is received by the stator; angular movement of the rotor relative to the stator moves the planetary gear pin relative to the slot and the planetary gear link about the pivot thereby transmitting angular motion of the first camshaft to the second camshaft through the planetary gear link.

In another implementation, a VCT assembly for controlling the angular position of camshafts includes an independent VCT device that is configured to couple with a first camshaft and change an angular position of the first camshaft relative to the angular position of a crankshaft; the independent VCT device includes: a stator and an output fixedly coupled with the first camshaft; a dependent VCT device that angularly adjusts a second camshaft in response to angular adjustment of the first camshaft includes: a camshaft link, coupled with the output of the independent VCT device, having a plurality of slots or a plurality of planetary gear pins positioned radially, outwardly from an axis of camshaft rotation; a plurality of planetary gear links including: a geared surface configured to engage a geared surface coupled to the second camshaft, the slots or the planetary gear pins, and a plurality of planetary gear pivots, wherein angular movement of the output relative to the stator moves the planetary gear pins relative to the slots and the planetary gear links about the pivots thereby transmitting angular motion of the first camshaft to the second camshaft through the planetary gear links.

DETAILED DESCRIPTION

A variable camshaft timing (VCT) assembly comprises an independent VCT device and a dependent VCT device that collectively control the angular position of a first camshaft and a second camshaft. The first and second camshafts can be concentrically positioned relative to each other. The independent VCT device receives rotational input from a crankshaft through an endless loop or geared timing drive. The first camshaft is coupled to an output of the independent VCT device that changes the angular position of the first camshaft relative to the crankshaft. Independent VCT devices can be implemented using electrically-actuated or hydraulically-actuated camshaft phasers. One implementation of an electrically-actuated camshaft phaser is described in U.S. Patent Application Publication No. 2017/0248045 the entirety of which is incorporated by reference. A dependent VCT device can link the output of the independent VCT device to a second camshaft and change the angular position of the second camshaft relative to the first camshaft. The dependent VCT device can include a camshaft link that is rigidly coupled with the output of the independent VCT device and has a slot that is positioned radially outwardly from an axis of camshaft rotation. The dependent VCT device can also include a planetary gear link that has a geared surface to engage a gear of the second camshaft, a pivot that can be carried by the independent VCT device, and a pin that is slidably received by the slot in the camshaft link. As the output of the independent VCT device angularly displaces the first camshaft with respect to the crankshaft, the angular motion of the output also can simultaneously change the angular position of the second camshaft with respect to the first camshaft.

The angular position of the second camshaft relative to the first camshaft can be controlled by selecting motion variables attributed to the dependent VCT device. The motion variables include the distance of the slot in the camshaft link from the axis of camshaft rotation, the shape of the slot, a gear ratio between the geared surface of the second camshaft relative to the geared surface of the planetary gear link, the size of the planetary gear link, and the distance between the planetary gear pivot and the planetary gear pin received by the slot. The amount of relative angular movement between the first and second camshafts, along with the rate at which the relative movement occurs, can be defined by the selection of these motion variables.

Figure 1:
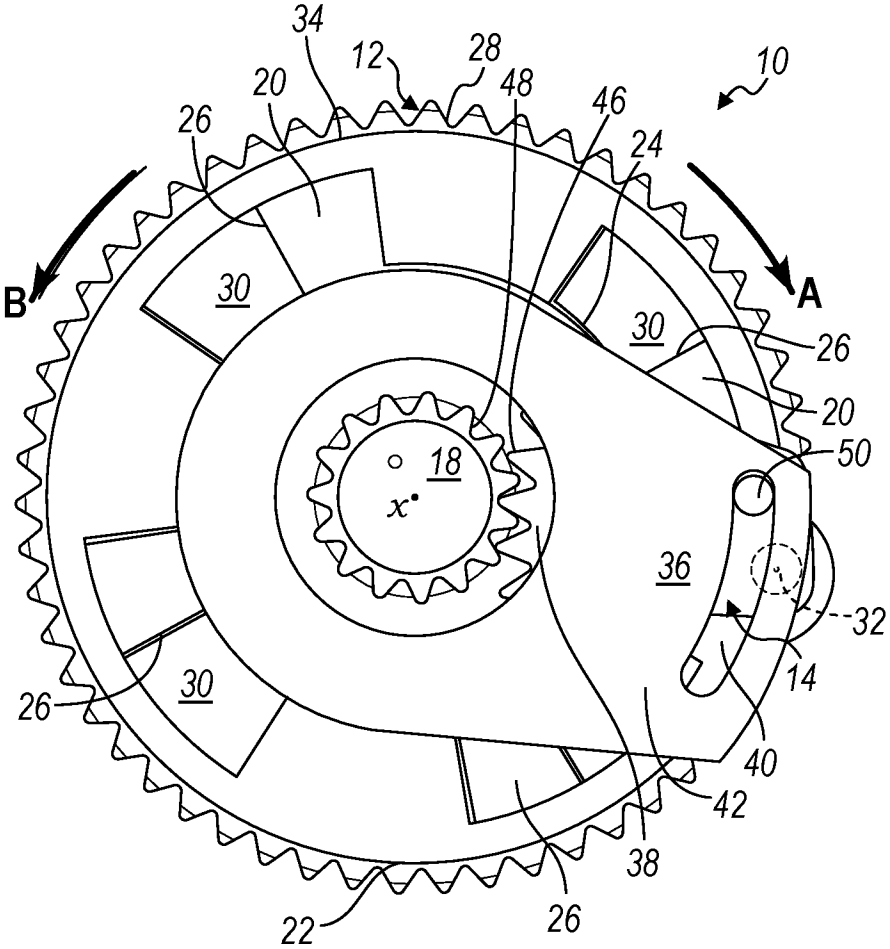
FIG. 1 is a perspective view depicting an implementation of a variable camshaft timing (VCT) assembly.

Internal combustion engines (ICEs) use reciprocating pistons linked to a crankshaft. The pistons move within cylinders in response to controlled combustion of air and fuel in the presence of spark in combustion chambers. The control of the combustion is at least partially regulated by opening and closing intake and exhaust valves using rotating camshafts. The camshafts rotate relative to the crankshaft and during rotation the camshafts open and close intake and exhaust valves at specified times relative to the delivery of spark to the combustion chambers of the cylinders. ICEs can implement multiple camshafts in different ways. For example, some ICEs use multiple camshafts, dedicating one camshaft for controlling the operation of intake valves and another camshaft for controlling the operation of exhaust valves. And in some implementations, the intake valve camshaft and the exhaust valve camshaft are concentrically positioned relative to each other. In other implementations, concentric camshafts may be used to actuate a portion of the intake (or exhaust) valves relative to the remainder of the intake (or exhaust) valves. Concentrically positioned camshafts include a first concentric camshaft and a second concentric camshaft that can change angular position relative to each other. Concentric camshafts are known by those skilled in the art, an example of which is shown in FIG. 1 of U.S. Pat. No. 8,186,319 and described in column 6, lines 10-53; the contents of that portion of U.S. Pat. No. 8,186,319 are incorporated by reference. The VCT assembly can use a single sensor wheel to determine the angular position of both camshafts. Given the precise and predictable mechanical relationship between the rotational movement of the dependent VCT device relative to the rotational motion imparted on it by the output of the independent VCT device, the angular position of both camshafts can be resolved using one signal received from a single camshaft sensor wheel.

Figure 2:
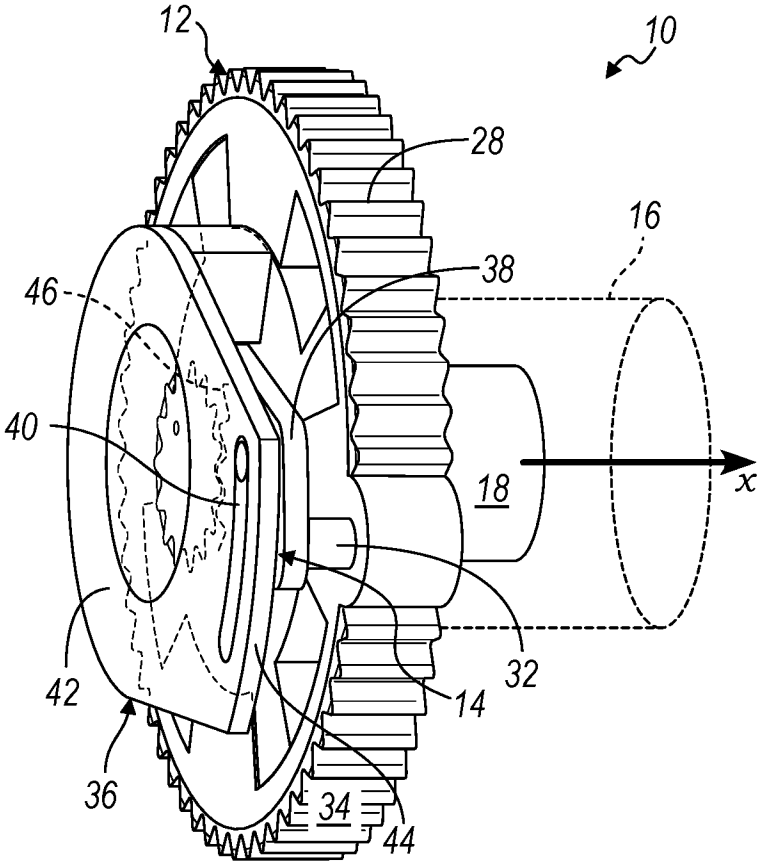
FIG. 2 is another perspective view depicting an implementation of the VCT assembly.

Turning to FIGS. 1-2, an implementation of a VCT assembly 10 is shown. The VCT assembly 10 includes an independent VCT device 12 and a dependent VCT device 14. The independent VCT device 12 has an output that is coupled with an end of an outer concentric camshaft 16 and the dependent VCT device 14 mechanically links the output of the independent VCT device 12 with an inner concentric camshaft 18. In this implementation, the output is a rotor 20 included in a hydraulically-actuated camshaft phaser. When the rotor 20 of the independent VCT device 12 moves the outer concentric camshaft 16 relative to a crankshaft (not shown) so that the angular position of the outer concentric camshaft 16 changes relative to the angular position of the crankshaft, the motion of the rotor 20 also changes the angular position of the inner concentric camshaft 18 relative to the outer concentric camshaft 16. It may be understood that the combination of inner concentric camshaft and outer concentric camshaft is provided by way of example. However, other implementations using the independent VCT device and the dependent VCT device are possible. For example, one or both of the camshafts refer to an intermediate gear or sprocket used to actuate a camshaft not on the same axis as the VCT assembly.

The independent VCT device 12 in this implementation is a hydraulically-actuated camshaft phaser having the rotor 20 and a housing 22 (also referred to as a stator). The rotor 20 includes a generally annular hub 24 and one or more vanes 26 extending radially outwardly from the hub 24. In this implementation, the rotor 20 includes four vanes 26 and serves as the output of the independent VCT device 12. The rotor 20 is rigidly coupled with the outer concentric camshaft 16 in a way that prevents rotational or radial displacement between the rotor 20 and the outer concentric camshaft 16. The housing 22 can have a generally cylindrically-shaped outer surface and include a camshaft sprocket 28, a plurality of fluid chambers 30 for receiving the vanes 26, and a planetary gear pivot 32. The housing 22 can use an inner plate 22*a* (discussed later in more detail and shown in FIGS. 9*a*-9*c*) that couples to the outer concentric camshaft 16 or inner concentric camshaft 18. The camshaft sprocket 28 can include a plurality of radially-outwardly extending sprocket teeth that extend in an uninterrupted row along a radial surface 34 of the housing 22. The camshaft sprocket 28 engages an endless loop (not shown), such as a chain, which also engages a crankshaft sprocket (not shown) and translates the rotational force created by the crankshaft into rotational motion of the housing 22. As the crankshaft rotates during engine operation, the housing 22 correspondingly rotates as well. The planetary gear pivot 32 permits a planetary gear link to rotate or pivot relative to the housing 22 about an axis (a) substantially parallel to an axis of camshaft rotation (x). The planetary gear pivot 32 is positioned radially outwardly from the axis of camshaft rotation (x).

During engine operation, the crankshaft rotates and that rotation is communicated to the housing 22 of the independent VCT device 12 through the endless loop. The independent VCT device 12 transmits that force to the inner and outer concentric camshafts 16, 18 through the rotor 20. The rotor 20 can be angularly displaced relative to the housing 22 thereby changing the angular position of the outer concentric camshaft 16 relative to the crankshaft. Pressurized fluid can be selectively directed to one side of the vane(s) 26 to move the rotor 20 relative to the housing 22 in one angular direction or directed to the other side of the vanes 26 to move the rotor 20 relative to the housing 22 in another angular direction. This angular movement can also be referred to as advancing or retarding the angular position between the camshaft(s) and the crankshaft. Or the rotor 20 can maintain its relative position relative to the housing 22 thus maintaining the phase relationship between the inner concentric camshaft 18 and the outer concentric camshaft 20. An example of a hydraulically-actuated camshaft phaser is described in U.S. Pat. No. 8,356,583 the contents of which are hereby incorporated by reference.

The dependent VCT device 14 in this implementation includes a camshaft link 36 and a planetary gear link 38 that mechanically connect the output of the independent VCT device 12 to the inner concentric camshaft 18. The dependent VCT device 14 communicates rotational movement of the rotor 20 and the outer concentric camshaft 16 to the inner concentric camshaft 18 in a precise relationship that is controlled by the camshaft link 36 and the planetary gear link 38. The camshaft link 36 can be formed from a rigid material, such as any one of a number of steel or aluminum alloys, and fixedly coupled to the rotor 20 in a way that resists deformation and/or relative angular displacement between the camshaft link 36 and the rotor 20. The camshaft link 36 rotates along with the rotor 20 to translate rotational movement from the rotor 20 through the link 36. A slot 40 can be formed in the camshaft link 36 extending from a first face 42 of the camshaft link 36 through to a second face 44 and positioned radially outwardly from an axis of camshaft rotation (x).

The planetary gear link 38 includes a geared surface 46 that has a plurality of gear teeth that extend radially inwardly toward the axis of camshaft rotation (x). The gear teeth of the geared surface 46 can be sized to mesh and engage with a geared surface 48 included on the inner concentric camshaft 18. The geared surface 48 includes a plurality of gear teeth that extend around the circumference of the inner concentric camshaft 18 and radially outwardly from the axis of camshaft rotation (x). A pin 50 extends away from and orthogonal to a face of the planetary gear link 38 and may have a circular cross-section with a diameter that closely conforms to the slot 40 of the camshaft link 36. The planetary gear link 38 can be implemented using a sector gear having a plurality of gears on a portion of an outer radial surface. The slot 40 can receive the pin 50 and permit the pin 50 to slide within the slot 40. As the camshaft link 36 rotates with the outer concentric camshaft 16, the slot 40 exerts a force radially inwardly toward or radially outwardly away from the axis of camshaft rotation (x). The force exerted by the camshaft link 36 on the pin 50 through the slot 40 can cam and rotate the planetary gear link 38 about the planetary gear pivot 32 in a clockwise or counterclockwise direction.

As the housing 22 rotates, so too do the other components of the independent VCT device 12 and the dependent VCT device 14. A valve (not shown) can control the pressurized fluid to move the rotor 20 in one angular direction, move the rotor 20 in another angular direction, or maintain the angular position of the rotor 20 relative to the housing 22. When the valve directs the rotor 20 to move relative to the housing 22, this angular movement moves the outer concentric camshaft 16 relative to the crankshaft. The angular movement of the rotor 20 also changes the angular position of the inner concentric camshaft 18 relative to the outer concentric camshaft 16. For example, if the rotor 20 moves to advance timing of the outer concentric camshaft 16 relative to the crankshaft, the rotor 20 can move clockwise in direction A. As the rotor 20 changes its angular position relative to the housing 22, the rotor 20 moves the camshaft link 36 in a clockwise direction as well. The pin 50 slides within the slot 40 exerting force from the camshaft link 36 to the planetary gear link 38 causing the planetary gear link 38 to pivot about the planetary gear pivot 32 in a counter-clockwise direction. The rotational movement of the planetary gear link 38 angularly displaces the inner concentric camshaft 18 relative to the outer concentric camshaft 16 through the geared surfaces 46, 48 thereby translating the rotational movement of the rotor 20/outer concentric camshaft 16 into corresponding rotational movement of the inner concentric camshaft 18 in a first angular direction (direction A).

Conversely, moving the rotor 20 to retard timing of the outer concentric camshaft 18 relative to the crankshaft can rotate the rotor 20 counter-clockwise in direction B. As the rotor 20 changes its angular position relative to the housing 22 in direction B, the rotor 20 moves the camshaft link 36 in a counterclockwise direction as well. The pin 50 slides within the slot 40 exerting force from the camshaft link 36 to the planetary gear link 38 causing the planetary gear link 38 to pivot about the planetary gear pivot 32 in a clockwise direction. The rotational movement of the planetary gear link 38 angularly displaces the inner concentric camshaft 18 relative to the outer concentric camshaft 16 through the geared surfaces 46, 48 thereby translating the rotational movement of the rotor 20/outer concentric camshaft 16 into corresponding rotational movement of the inner concentric camshaft 18 in a second angular direction (direction B).

Figure 3:
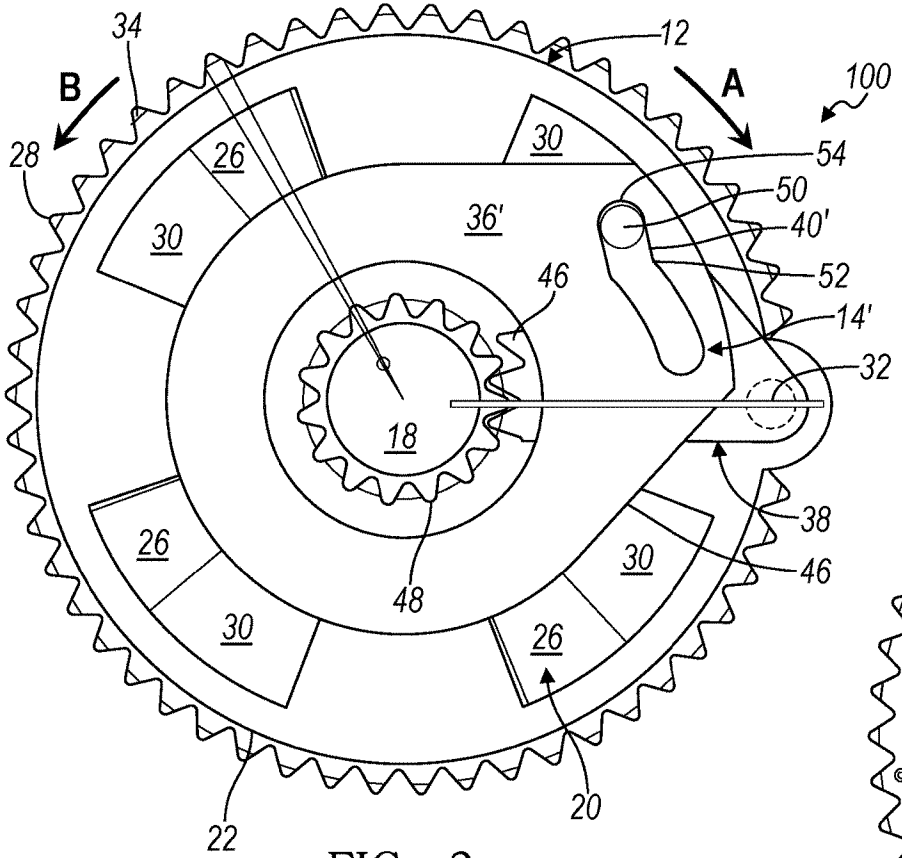
FIG. 3 is a profile view depicting another implementation of a VCT assembly.
Figure 4:
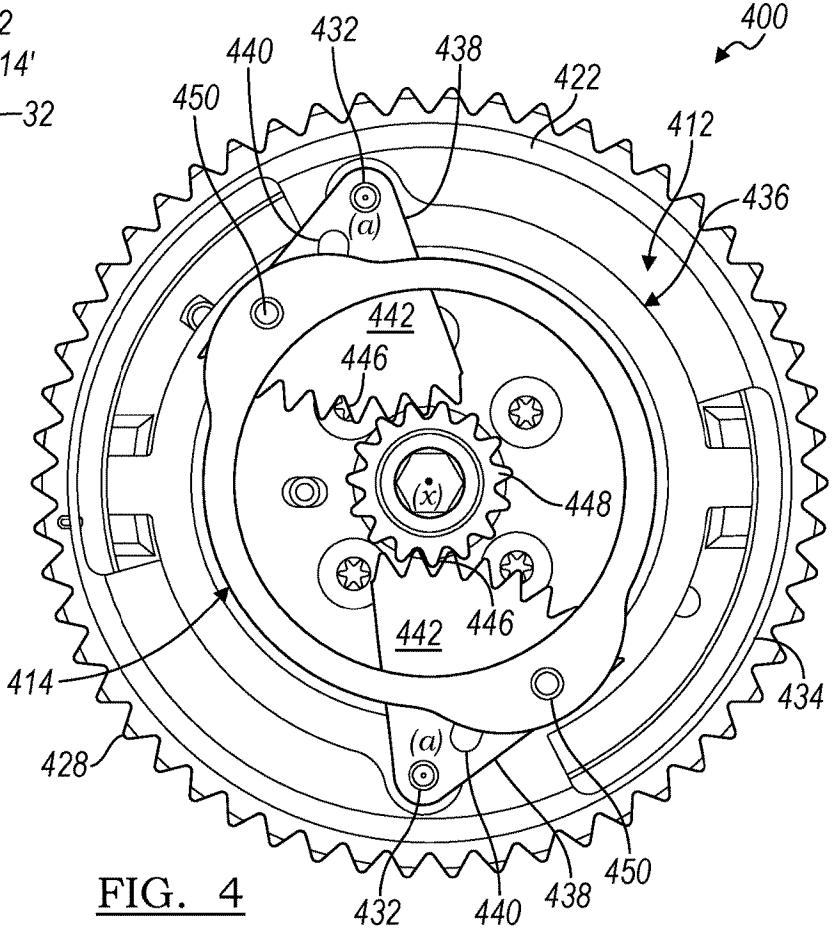
FIG. 4 is a profile view depicting another implementation of a VCT assembly.
Figure 5:
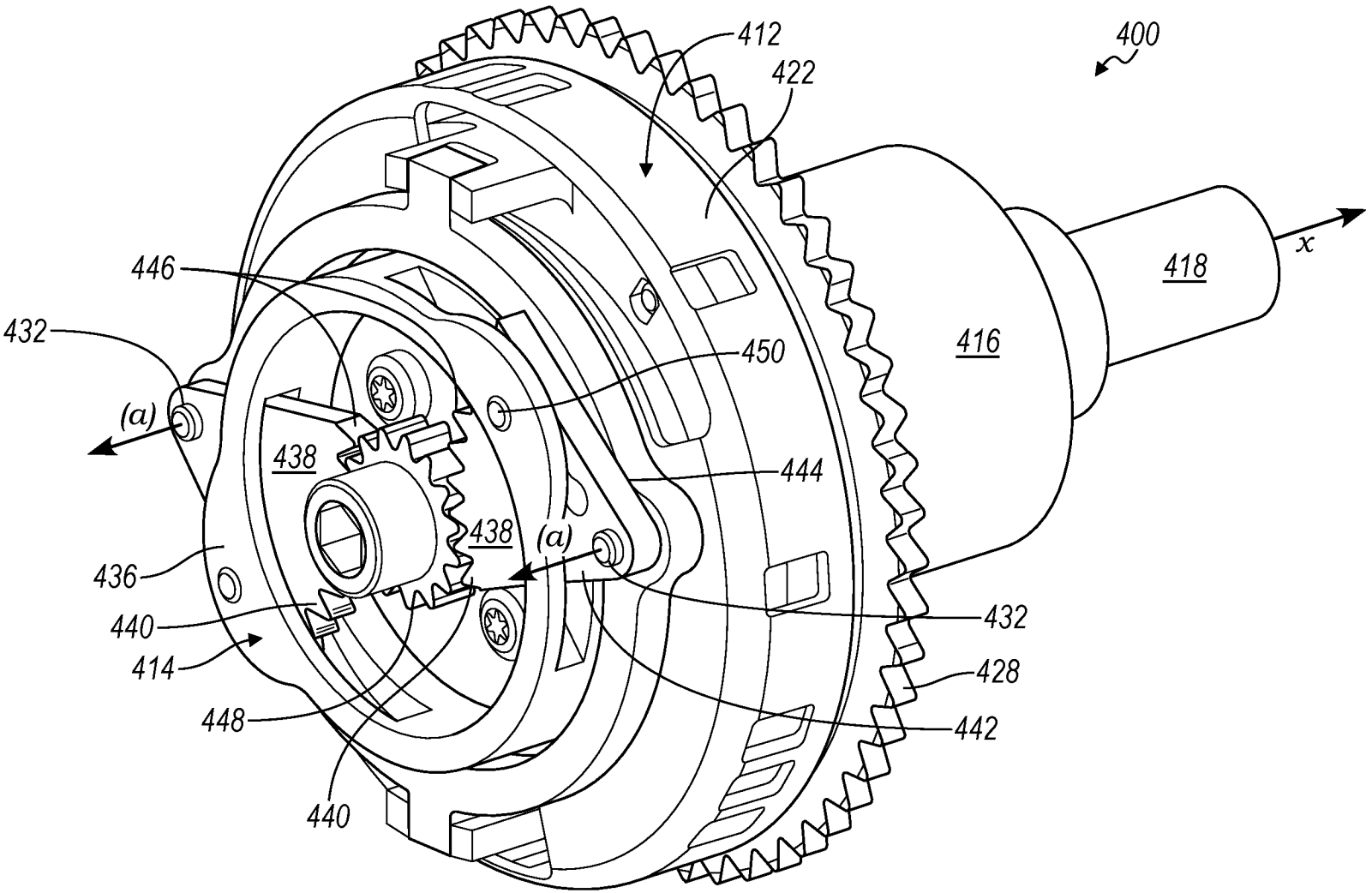
FIG. 5 is a perspective view depicting another implementation of a VCT assembly.
Figure 6:
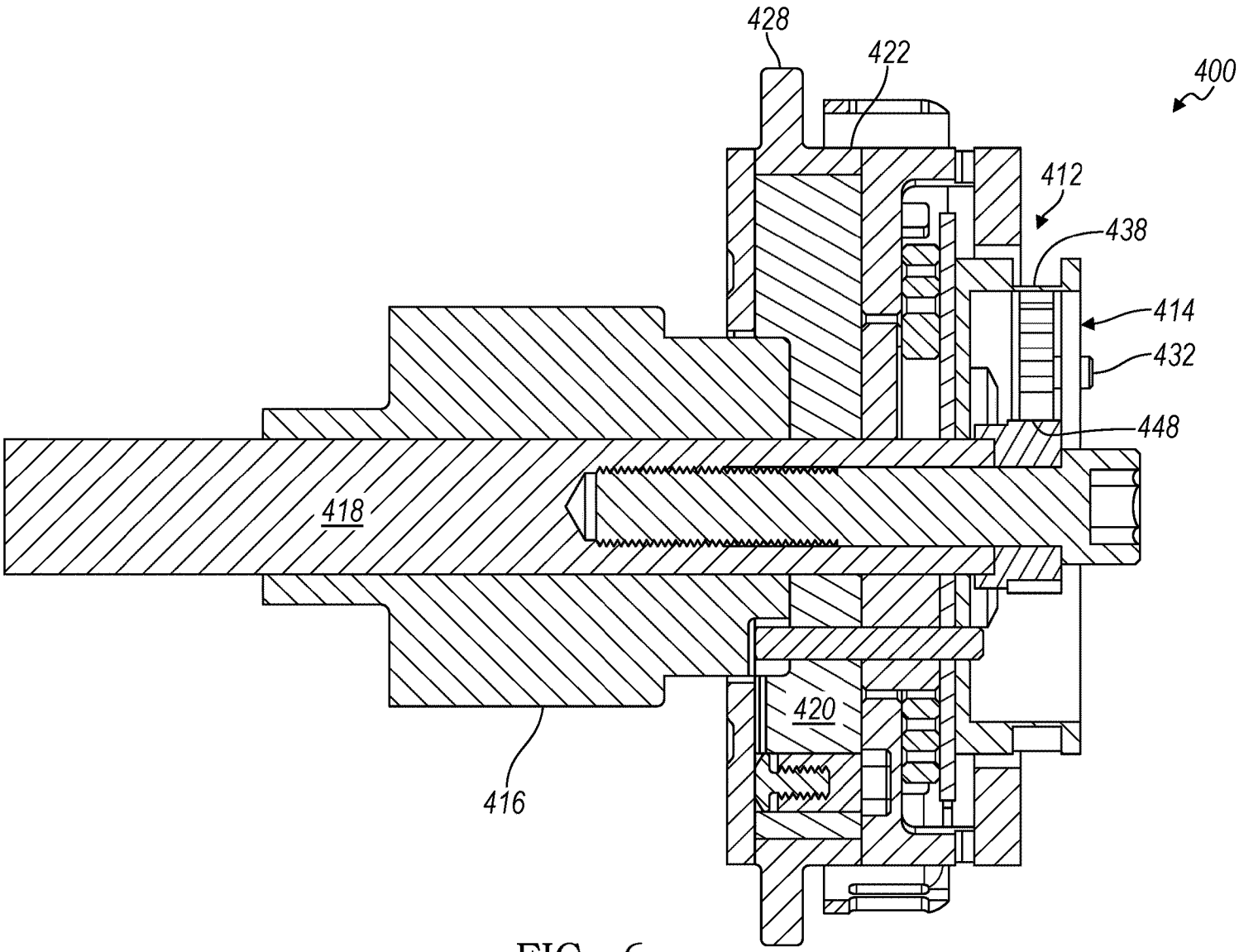
FIG. 6 is a cross-sectional view depicting another implementation of a VCT assembly.
Figure 7:
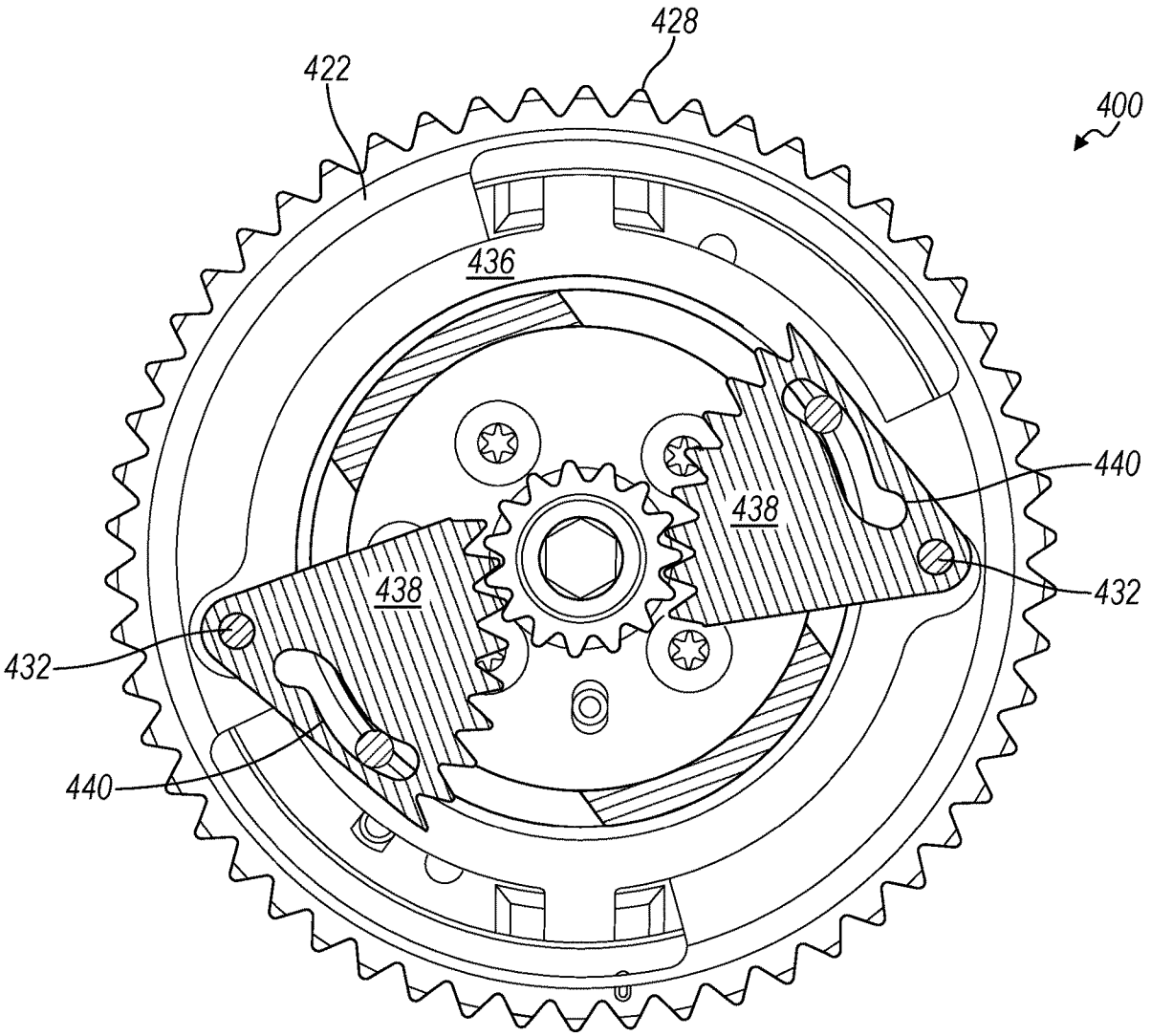
FIG. 7 is a profile view depicting another implementation of a VCT assembly.

Turning to FIG. 3, another implementation of a VCT assembly 300 is shown. The VCT assembly 300 is similar to the implementation described above and shown in FIGS. 1-2. However, the slot 40' can be shaped in a way that causes the relative angular motion of the inner concentric camshaft 18 to change relative to the angular motion of the camshaft link 36'. For example, the slot 40' can be shaped to include an inflection point 52 and as the camshaft link 36' rotates in angular direction A, the pin 50 moves within the slot 40' beginning at and away from one end 54. The inner concentric camshaft 18 also rotates in angular direction A. As the pin 50 continues moving away from the end 54 of the slot 40' and passes the inflection point 52, the inner concentric camshaft 18 changes its angular direction relative to the camshaft link 36'. The inner concentric camshaft 18 begins moving in angular direction B while the camshaft link 36' continues moving in angular direction B. The slot of the camshaft link can be shaped in any one of a variety of different ways to control the relative motion of the inner concentric camshaft relative to the outer concentric camshaft.

FIGS. 4-7 depict yet another implementation of a VCT assembly 400. The VCT assembly 400 includes a plurality of planetary gear links 438. In this implementation, the planetary gear links 438 each include a slot 440 whereas a camshaft link 436 can carry planetary gear pivots 432 for each planetary gear link 438.

The independent VCT device 412 in this implementation is a hydraulically-actuated camshaft phaser as described above. A rotor 420 is rigidly coupled with an outer concentric camshaft 416 in a way that prevents rotational or radial displacement between the rotor 420 and the outer concentric camshaft 416. The independent VCT device 412 can include a housing 422 having a generally cylindrically-shaped outer surface and include a camshaft sprocket 428 and a plurality of planetary gear pivots 432. The camshaft sprocket 428 can include a plurality of radially-outwardly extending sprocket teeth that extend in an uninterrupted row along a radial surface 434 of the housing 422. The camshaft sprocket 428 engages an endless loop (not shown), such as a chain, which also engages a crankshaft sprocket (not shown) and translates the rotational force created by the crankshaft into rotational motion of the housing 422. As the crankshaft rotates during engine operation, the housing 422 correspondingly rotates as well. The planetary gear pivots 432 permit the planetary gear links 438 to rotate or pivot relative to the housing 422 about axes (a) substantially parallel to an of camshaft rotation (x). The planetary gear pivots 432 are positioned radially outwardly from the axis of camshaft rotation (x).

The dependent VCT device 414 in this implementation includes a camshaft link 436 and two planetary gear links 438 that mechanically connect the output of the independent VCT device 412 to the inner concentric camshaft 418. The dependent VCT device 414 communicates rotational movement of the rotor 420 and the outer concentric camshaft 416 to the inner concentric camshaft 418 in a precise relationship that is controlled by the camshaft link 436 and the planetary gear links 438. The camshaft link 436 can be annularly shaped having an inner diameter and an outer diameter. The camshaft link 436 includes two planetary gear pivots 432 that rotate about pivot axes (a). Slots 440 can be formed in the planetary gear links 438 extending from a first face 442 of the planetary gear links 438 through to a second face 444 and positioned radially outwardly from an axis of camshaft rotation (x).

The planetary gear links 438 includes a geared surface 446 that has a plurality of gear teeth extending radially inwardly toward the axis of camshaft rotation (x). The gear teeth of the geared surface 446 can be sized to mesh and engage with a geared surface 448 included on the inner concentric camshaft 418. The geared surface 448 includes a plurality of gear teeth that extend around the circumference of the inner concentric camshaft 418 and radially outwardly from the axis of camshaft rotation (x). Pins 450 extends from a surface of the camshaft link 436 and may have a circular cross-section with a diameter that closely conforms to the slots 440 of the planetary gear link 438. The planetary gear links 438 can be implemented using sector gears having a plurality of gears on a portion of an outer radial surface. The slots 440 can receive the pins 450 and permit the pins 450 to slide within the slot 440. As the camshaft link 436 rotates with the outer concentric camshaft 416, the slots 440 exert a force radially inwardly toward or radially outwardly away from the axis of camshaft rotation (x). The force exerted by the camshaft links 436 on the pins 450 through the slots 440 can cam and rotate the planetary gear links 438 about the planetary gear pivots 432 in a clockwise or counterclockwise direction.

The VCT assemblies disclosed herein can use compliance couplings to prevent binding of the geared surfaces and prevent backlash thereby ensuring that the geared surfaces can move relative to each other despite angular deflection or offset relative to the axis of camshaft rotation (x) between two or more components, such as the outer concentric camshaft 16 and the inner concentric camshaft 18. In one implementation, shown in FIG. 8 an inner camshaft compliant coupling 56 can be positioned axially along the axis (x) of camshaft rotation between a distal end 58 of the inner concentric camshaft 18 and the geared surface 48 of the camshaft 18. The geared surface 48 can include a groove 60 extending transverse to the axis (x) of camshaft rotation and axially face the inner camshaft compliant coupling 56. A first rail 62, corresponding in size and cross-sectional shape to the groove 60, can be included with the inner camshaft compliant coupling 56 so that the first rail 62 and groove 60 slidably engage permitting the geared surface 48 to move relative to the coupling 56 transverse to the axis of camshaft rotation (x). The inner camshaft compliant coupling 56 can also include a second rail 64, articulated 90° from the first rail 62, to fit with a second groove 66 in the distal end 58 of the inner concentric camshaft 18. The second rail 64 can slidably engage the second groove 66 permitting the inner concentric camshaft 18 to move relative to the coupling 56 transverse to the direction of movement between the geared surface 48 and the inner camshaft compliant coupling 56. It should be appreciated that the location of rails and grooves can be swapped in other implementations.

Figures 8, 9A:
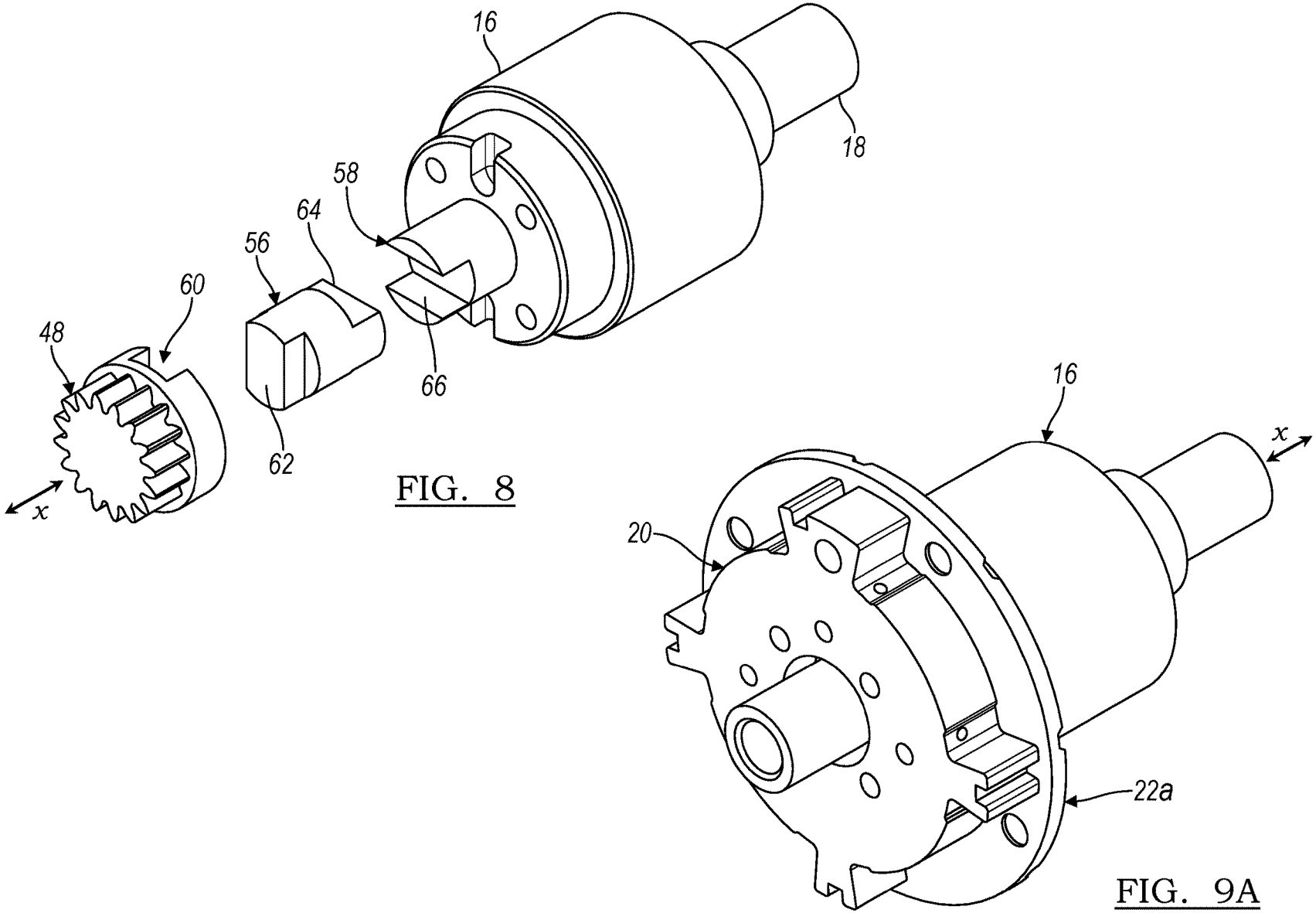
FIG. 8 is a perspective view of a portion of an implementation of a VCT assembly including a compliant coupling.
FIG. 9*a* is a perspective view of a portion of another implementation of a VCT assembly including a compliant coupling.
Figure 9B:
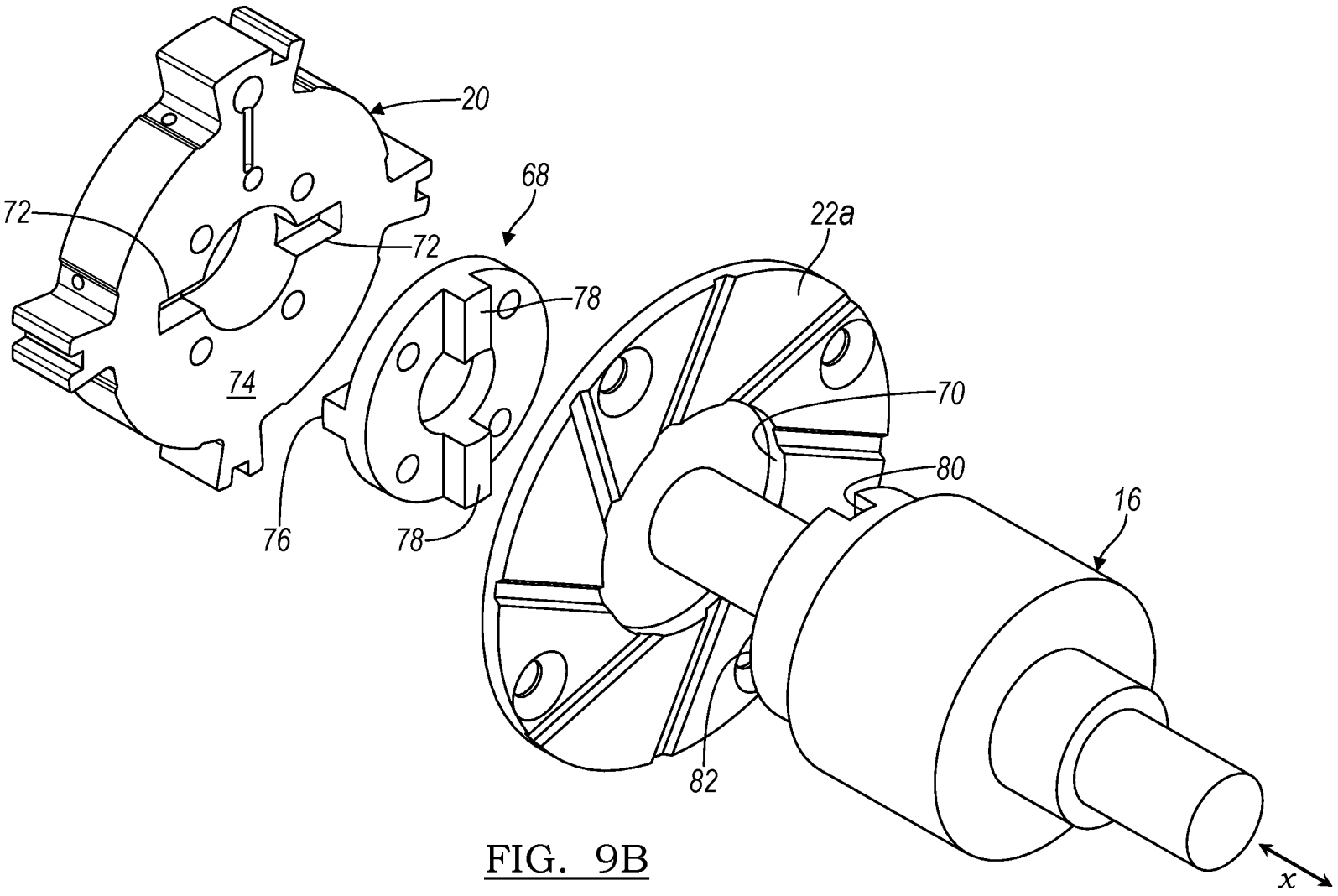
FIG. 9*b* is an exploded view of a portion of another implementation of a VCT assembly including a compliant coupling.
Figure 9C:
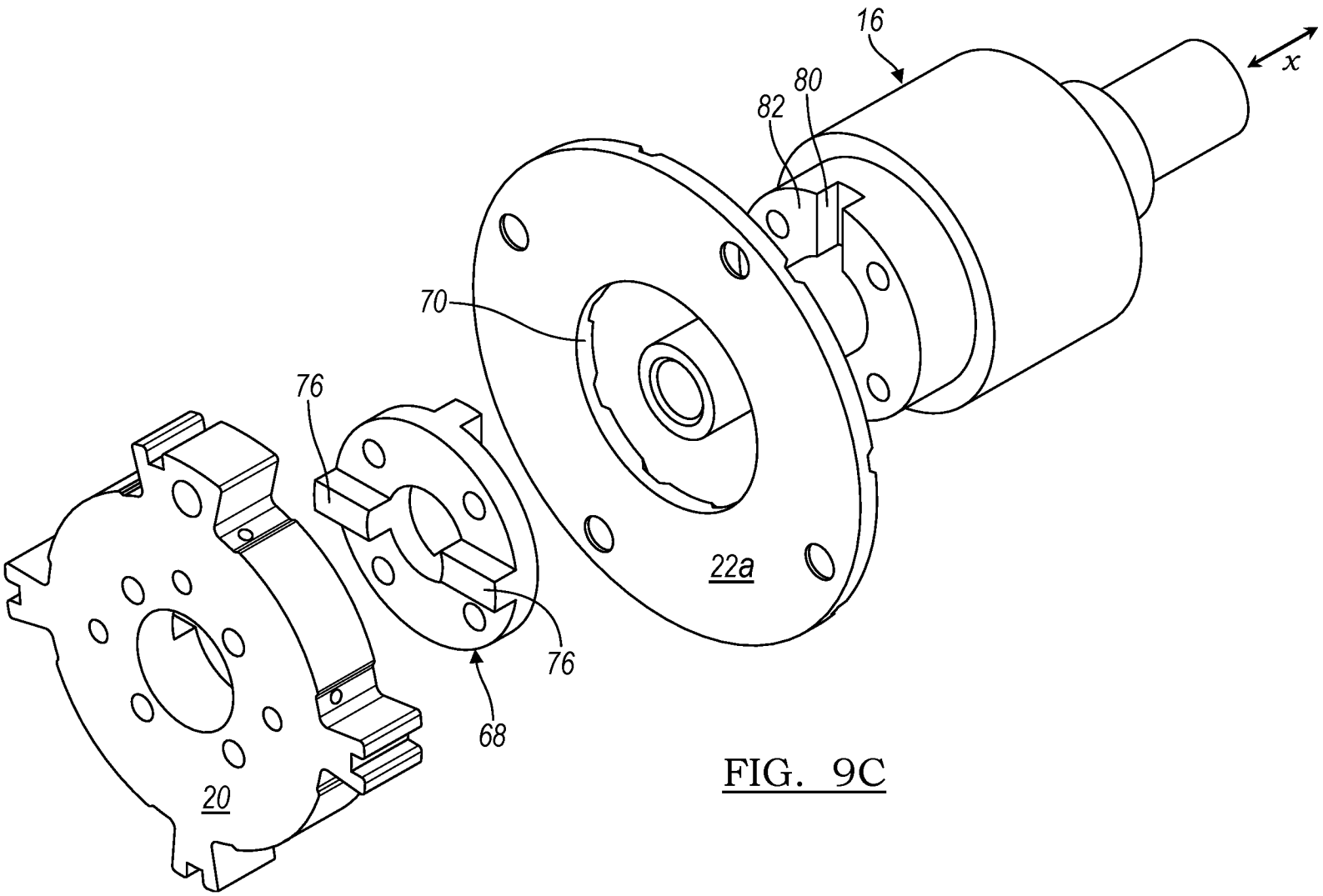
FIG. 9*c* is another exploded view of a portion of another implementation of a VCT assembly including a compliant coupling.

In another implementation shown in FIGS. 9*a*-9*c*, an outer camshaft compliant coupling 68 is axially positioned along the axis of camshaft rotation (x) between the outer concentric camshaft 16 and the rotor 20. The outer camshaft compliant coupling 68 can fit concentrically within an inner diameter 70 of the inner plate 22*a*. The rotor 20 can include grooves 72 recessed within an axial surface 74 of the rotor 20 and extend perpendicular to the axis of camshaft rotation (x). The outer camshaft compliant coupling 68 can include a first set of rails 76 that correspond in size and cross-sectional shape to the grooves 72 so that the rails 76 and grooves 72 slidably engage permitting the rotor 20 to move relative to the coupling 68 transverse to the axis of camshaft rotation (x). The outer camshaft compliant coupling 68 can also include a second set of rails 78, articulated 90° from the first set of rails 76, to fit with grooves 80 in a distal end 82 of the outer concentric camshaft 16. The second set of rails 78 can slidably engage the grooves 80 permitting the outer concentric camshaft 16 to move relative to the outer camshaft compliant coupling 68 transverse to the direction of movement between the rotor 20 and the coupling 68.

Figure 10A:
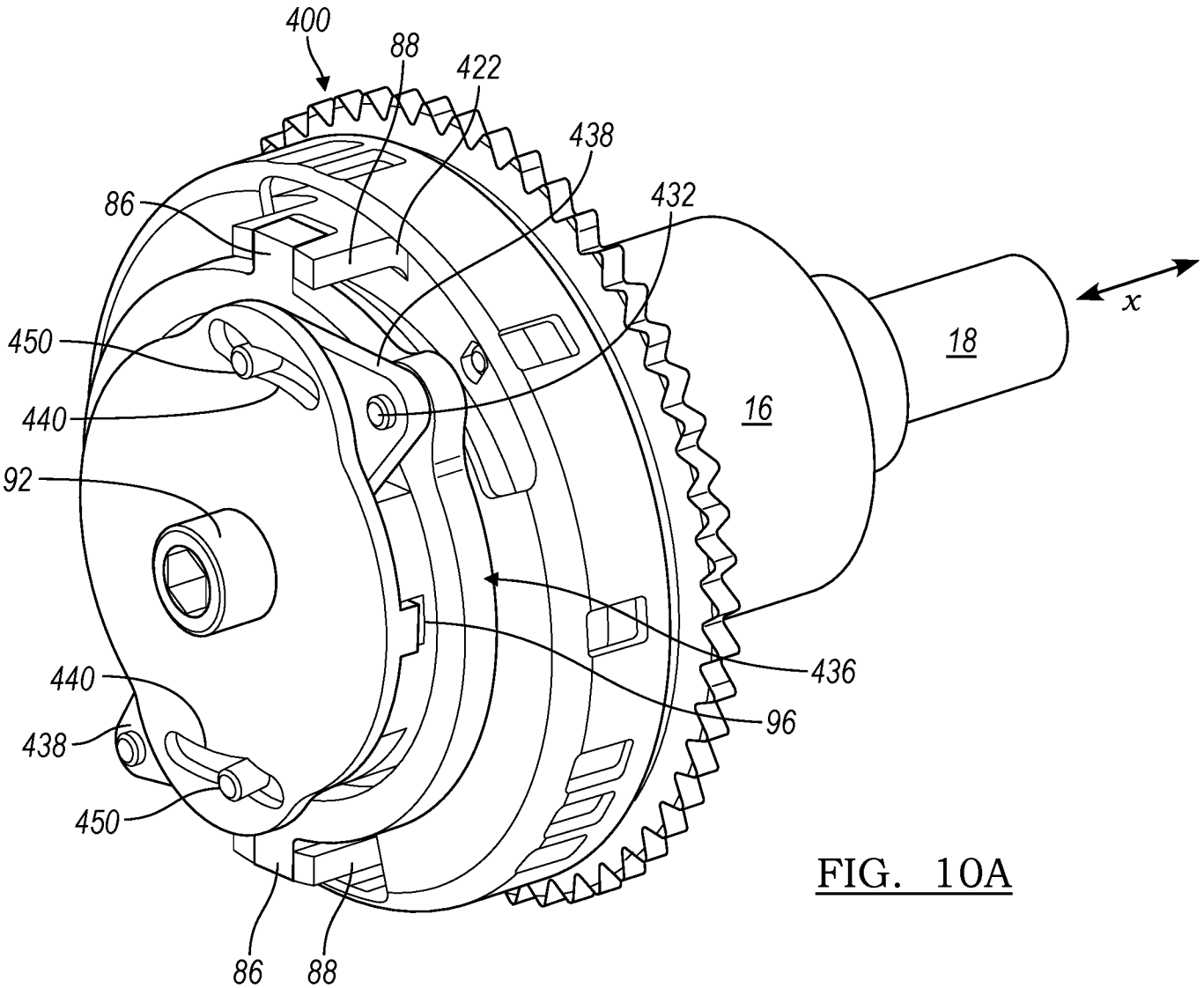
FIG. 10*a* is a perspective view of a portion of yet another implementation of a VCT assembly including a compliant coupling.
Figure 10B:
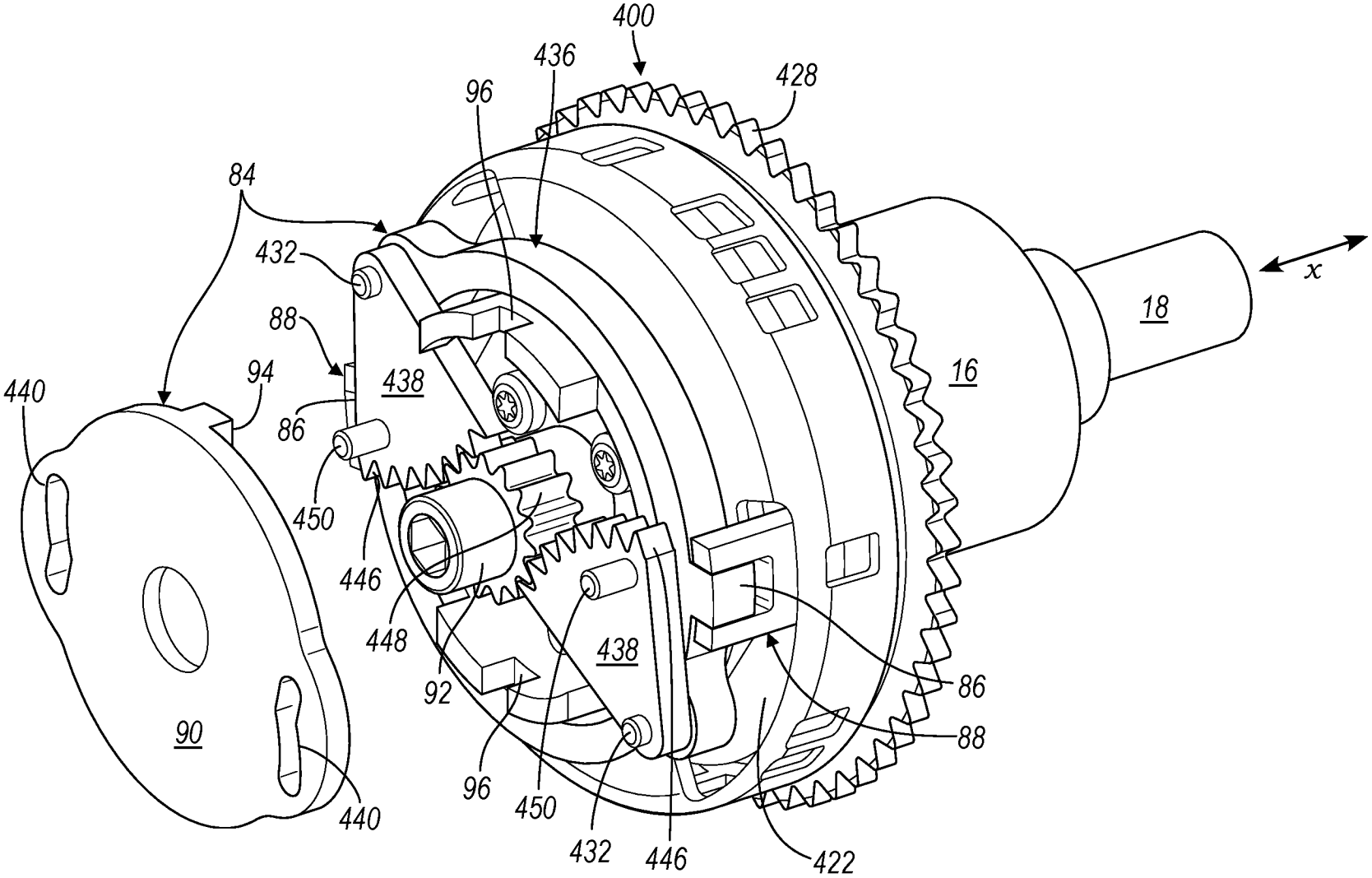
FIG. 10*b* is a partially exploded view of a portion of yet another implementation of a VCT assembly including a compliant coupling.

In yet another implementation shown in FIGS. 10*a*-10*b*, a camshaft link compliant coupling 84 exists between the camshaft link 436 and the housing 422 with respect to the VCT assembly 400. The camshaft link 436 can include two tabs 86 radially outwardly extending from the camshaft link 436 away from the axis (x) of camshaft rotation. The housing 422 can include a first set of corresponding slots 88 for slidably receiving the tabs 86 and permitting movement of the camshaft link 436 relative to the housing 422 in a direction perpendicular to the axis of camshaft rotation (x). An end plate 90 of the camshaft link 436 can rotate with the camshaft link 436 thereby sliding the pins 450 along the pathway of the slots 440. The motion of the end plate 90 can be communicated to the inner camshaft 18 through the pins 450 that can exert force on the slots 440 thereby inducing the relative rotational movement of the inner camshaft 18. The end plate 90 can include one or more rails 94 extending in a direction 90° from the tabs 86. The rail(s) 94 can closely conform in size and cross-sectional shape to a second set of corresponding slots 96 in the housing 422. The rail(s) 94 can slidably engage the slots 96 permitting the inner concentric camshaft 18 to move relative to the camshaft link 436 transverse to the direction of movement between the link 436 and the housing 422.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) assembly for controlling an angular position of camshafts, comprising:
- an independent VCT device that is configured to couple with a first camshaft and change an angular position of the first camshaft relative to the angular position of a crankshaft comprising:
  - a stator:
  - an output fixedly coupled with the first camshaft;
- a dependent VCT device that angularly adjusts a second camshaft in response to angular adjustment of the first camshaft comprising:
  - a camshaft link, coupled with the output of the independent VCT device, having a slot or a planetary gear pin positioned radially, outwardly along an axis of camshaft rotation;
  - a planetary gear link including: a geared surface configured to engage a geared surface coupled to the second camshaft, the other of the slot or the planetary gear pin, and a planetary gear pivot, wherein the slot engages the pin and angular movement of the output relative to the stator moves the planetary gear pin within the slot and about the planetary gear pivot thereby transmitting angular motion of the first camshaft to the second camshaft through the planetary gear link.

2. The VCT assembly recited in claim 1, wherein the first camshaft is concentric to the second camshaft.

3. The VCT assembly recited in claim 1, wherein the independent VCT device is hydraulically-actuated.

4. The VCT assembly recited in claim 1, wherein the planetary gear link is a sector gear.

5. The VCT assembly recited in claim 1, wherein the slot includes an inflection point at which the second camshaft begins moving in a different angular direction relative to the camshaft link.

6. The VCT assembly recited in claim 1, further comprising a compliance coupling.

7. The VCT assembly recited in claim 6, wherein the compliance coupling slidably couples the geared surface coupled to the second camshaft and the second camshaft.

8. The VCT assembly recited in claim 6, wherein the compliance coupling slidably couples the output and the first camshaft.

9. The VCT assembly recited in claim 6, wherein the compliance coupling slidably couples the camshaft link and the independent VCT device.

10. A variable camshaft timing (VCT) assembly for controlling an angular position of camshafts, comprising:
- an independent VCT device that is configured to couple with a first camshaft and change an angular position of the first camshaft relative to the angular position of a crankshaft comprising:
  - a rotor, having one or more vanes extending radially outwardly from a hub, fixedly coupled with the first camshaft;
  - a stator that receives the rotor within a cavity permitting angular displacement of the rotor relative to the stator;
- a dependent VCT device that angularly adjusts a second camshaft in response to angular adjustment of the first camshaft comprising:
  - a camshaft link, coupled with the rotor of the independent VCT device, having a slot positioned radially, outwardly from an axis of camshaft rotation;
  - a planetary gear link including a geared surface configured to engage a geared surface coupled to the second camshaft, a planetary gear pin received by the slot of the camshaft link, and a planetary gear pivot that is received by the stator, wherein angular movement of the rotor relative to the stator moves the planetary gear pin relative to the slot and the planetary gear link about the planetary gear pivot thereby transmitting angular motion of the first camshaft to the second camshaft through the planetary gear link.

11. The VCT assembly recited in claim 10, wherein the first camshaft is concentric to the second camshaft.

12. The VCT assembly recited in claim 10, wherein the independent VCT device is hydraulically-actuated.

13. The VCT assembly recited in claim 10, wherein the planetary gear link is a sector gear.

14. The VCT assembly recited in claim 10, wherein the slot includes an inflection point at which the second camshaft begins moving in a different angular direction relative to the camshaft link.

15. The VCT assembly recited in claim 10, further comprising a compliance coupling.

16. The VCT assembly recited in claim 15, wherein the compliance coupling slidably couples the geared surface coupled to the second camshaft and the second camshaft.

17. The VCT assembly recited in claim 15, wherein the compliance coupling slidably couples the rotor and the first camshaft.

18. The VCT assembly recited in claim 15, wherein the compliance coupling slidably couples the camshaft link and the stator of the independent VCT device.

19. A variable camshaft timing (VCT) assembly for controlling an angular position of camshafts, comprising:

an independent VCT device that is configured to couple with a first camshaft and change an angular position of the first camshaft relative to the angular position of a crankshaft comprising:

a stator:

an output fixedly coupled with the first camshaft;

a dependent VCT device that angularly adjusts a second camshaft in response to angular adjustment of the first camshaft comprising:

a camshaft link, coupled with the output of the independent VCT device, having a plurality of slots or a plurality of planetary gear pins positioned radially, outwardly from an axis of camshaft rotation;

a plurality of planetary gear links including: a geared surface configured to engage a geared surface coupled to the second camshaft, the other of the plurality of slots or the planetary gear pins, and a plurality of planetary gear pivots, wherein the slots engage the pins and angular movement of the output relative to the stator moves the planetary gear pins within the slots and about the pivots thereby transmitting angular motion of the first camshaft to the second camshaft through the planetary gear links.

20. The VCT assembly recited in claim 19, further comprising a compliance coupling.

* * * * *